United States Patent [19]

Moschini

[11] Patent Number: 5,017,413

[45] Date of Patent: May 21, 1991

[54] METHOD OF AND DEVICES FOR ATTACHING COVERING LAYERS TO SUPPORTING STRUCTURES

[75] Inventor: Franco Moschini, Tolentino, Italy

[73] Assignee: Poltrona Frau S.p.A., Tolentino, Italy

[21] Appl. No.: 428,457

[22] Filed: Oct. 30, 1989

Related U.S. Application Data

[63] Continuation of Ser. No. 76,650, Jul. 23, 1987, abandoned.

[30] Foreign Application Priority Data

Jul. 23, 1986 [IT] Italy ..... 22620/86[U]

[51] Int. Cl.[5] ..... B32B 3/10

[52] U.S. Cl. ..... 428/61; 428/102; 428/62; 112/405; 112/418; 112/426

[58] Field of Search ..... 428/102, 61, 62; 156/304.4, 93; 112/405, 418, 426

[56] References Cited

U.S. PATENT DOCUMENTS

| | | | |
|---|---|---|---|
| 730,832 | 6/1903 | Loeb | 428/102 |
| 1,917,430 | 7/1933 | Clark | 428/102 |
| 4,303,712 | 12/1981 | Woodroof | 428/61 X |
| 4,331,723 | 5/1982 | Hamm | 428/102 X |

FOREIGN PATENT DOCUMENTS

| | | | |
|---|---|---|---|
| 2336833 | 2/1974 | Fed. Rep. of Germany | 112/418 |

*Primary Examiner*—Alexander S. Thomas
*Attorney, Agent, or Firm*—Peter K. Kontler

[57] ABSTRACT

A covering layer of leather, textile or plastic sheet material is indirectly attached to a supporting structure, such as a seat or a dashboard, by a band-like insert which is affixed to the covering layer by one or more rows of decorative stitches and is secured to the supporting structure by a pair of rod-like securing elements and a thread, or by one or more pairs of complementary male and female detent elements.

18 Claims, 2 Drawing Sheets

METHOD OF AND DEVICES FOR ATTACHING COVERING LAYERS TO SUPPORTING STRUCTURES

CROSS-REFERENCE TO RELATED CASE

This application is a continuation of application Ser. No. 076,650 filed July 23, 1987 now abandoned.

A commonly owned copending patent application Ser. No. 066,768 filed June 25, 1987 now U.S. Pat. No. 4,782,872 relates to a cover for steering wheels and the like.

BACKGROUND OF THE INVENTION

The invention relates to improvements in methods of and in devices for attaching covering layers, such as decorative layers of leather, fabric or plastic sheet material, to supporting structures. The attaching devices or attachments of the present invention can be used with advantage to secure covering layers to complex supporting structures such as molded dashboards in motor vehicles, seats, chairs or armchairs and/or others.

In accordance with heretofore known proposals, covering layers are attached to complex supporting structures by means of an adhesive. A drawback of such proposals is that solvents which are contained in adhesives are likely to penetrate through the covering layer and affect the appearance of the object. Moreover, the adhesive is likely to age and to permit separation of the covering layer from the supporting structure. For example aging of many types of adhesives is promoted by exposure to sun. Still further, adhesives cannot be used in connection with many types of covering layer materials and/or supporting structures and/or when the covering layer does not directly overlie the supporting structure because it must conceal one or more layers of cushioning material. For example, it is customary and often required to pad the dashboards of motor vehicles so as to soften the impact in the event of an accident. Bonding of covering layers to relatively thick and/or relatively soft paddings necessitates the utilization of large quantities of adhesive which is likely to provide unsightly spots at the exposed side of the covering layer.

Proposals to avoid reliance on adhesives include the utilization of staples, rivets, screws and like fasteners which are likely to detract from the appearance of the finished object and must be concealed behind moldings and/or capping strips at the exposed sides of the covering layers. This contributes to the cost-and bulk of the objects, especially if the supporting structure has a complex outline with cavities bounded by concave surfaces and/or protuberances bounded by convex surfaces.

OBJECTS AND SUMMARY OF THE INVENTION

An object of the invention is to provide a novel and improved attachment which can secure one-piece or composite covering layers to simple (e.g., flat) or complex supporting structures without resorting to adhesives, moldings, capping strips and the like.

Another object of the invention is to an attachment which contributes to the eye-pleasing appearance of the object including the supporting structure and the covering layer or layers.

A further object of the invention is to provide an attachment which can be used with particular advantage in motor vehicles for the application of covering layers to the frames of dashboards, seats, arm rests and like objects.

An additional object of the invention is to provide an attachment whose useful life is much longer than that of heretofore known attachments and whose appearance does not alter with age and/or as a result of exposure to sun rays or other types of radiation.

Still another object of the invention is to provide an attachment which can be used to secure covering layers to supporting structures with or without the interposition of one or more cushions.

Another object of the invention is to provide a dashboard, an arm rest, a seat or another object wherein the covering layer is secured to the supporting structure by means of the above outlined attachment.

A further object of the invention is to provide a novel and improved method of attaching covering layers of fine leather, expensive decorative fabric or like covering material to supporting structures of practically any desired size and/or shape.

Another object of the invention is to provide a method which can be practiced without the utilization of adhesive pastes or other materials or substances whose bonding action and/or other parameters are likely to change with age or as a result of exposure to sun rays.

One feature of the present invention resides in the provision of a combination of a supporting structure (e.g., the frame of a chair or a portion of a dashboard) and a covering layer (particularly a decorative fabric, leather or plastic sheet material having a first side facing toward and a second side facing away from the supporting structure) with an attachment for maintaining the covering layer in a position of overlap with the supporting structure. The attachment comprises a substantially panel-like insert which is adjacent a selected portion of the first side of the covering layer, means for mechanically fastening the insert to the covering layer, and means for securing the insert to the supporting structure. The fastening means preferably includes stitches; for example, the insert can include or constitute an elongated band or strip and the fastening means can include at least one row of stitches extending substantially longitudinally of the band or strip.

The securing means can include a first fastening element which is disposed between the insert and the first side of the covering layer, a second fastening element, and a substantially thread-like connector (this term is intended to include yarns, wires, laces, cords and like flexible bodies) which secures the fastening elements to each other. The supporting structure then includes a portion which is disposed between the first and second fastening elements, and at least one of these fastening elements can be elongated (e.g., at least one of the fastening elements can include an elongated rod and the connector can extend through one or more holes in the aforementioned portion of the supporting structure and can include one or more knots which are preferably adjacent the second fastening element).

Alternatively, the securing means can comprise at least one first detent element on the insert and a complementary second detent element which is provided on the supporting structure and engages the first detent element. For example, the first detent element can constitute or include a male detent element and the second detent element can constitute or include a female detent element. For example, one of the detent elements can include or constitute a socket and the other detent element can be received in the socket by snap action. To this end, the socket can be provided with a chamber and with a constriction which defines an inlet to the chamber, and the other detent element can be provided with a head which is forcibly insertable into the chamber by way of the inlet.

The first detent element can be integral with the insert; such detent element can be provided with at least one dovetailed recess which faces away from the covering layer. The second detent element of such securing means can include a head which is received in the dovetailed recess and a shank which is anchored in the supporting structure. The shank can have at least one laterally extending projection in the form of a screw thread or one or more rigid or deformable barbs, and the supporting structure is then provided with a hole for such projection and a portion at least of the shank. The hole in the supporting structure can be a tapped hole.

The covering layer can include two sections with abutting or rather closely adjacent marginal portions which overlie the insert. The fastening means of the connection including such composite covering layer preferably includes rows of stitches which connect the marginal portions to the insert. At least one of the marginal portions can include a flap which directly abuts the insert.

A padding (e.g., a layer of foam rubber or the like) can be interposed between the supporting structure and the covering layer.

Another feature of the present invention resides in the provision of a method of attaching a covering layer (particularly a decorative layer of leather, textile or plastic sheet material to a supporting structure (such as the skeleton of a chair, a portion of a dashboard or the like). The method comprises the steps of mechanically fastening a substantially panel-like insert (such as the aforementioned band or strip) to a selected portion of one side of the covering layer, and securing the insert to the supporting structure. The fastening step can include stitching the insert to the covering layer, and the securing step can include connecting the insert to the supporting structure by at least one pair of mating male and female detents. Alternatively, the securing step can include placing two substantially parallel rods at opposite sides of a selected portion of the supporting structure so that one of the rods is located between the covering layer and the panel-like insert, and connecting the rods to each other by means of a thread (e.g., by guiding the thread through openings in the selected portion of the supporting structure).

The novel features which are considered as characteristic of the invention are set forth in particular in the appended claims. The improved attachment itself, however, both as to its construction and the method of making the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
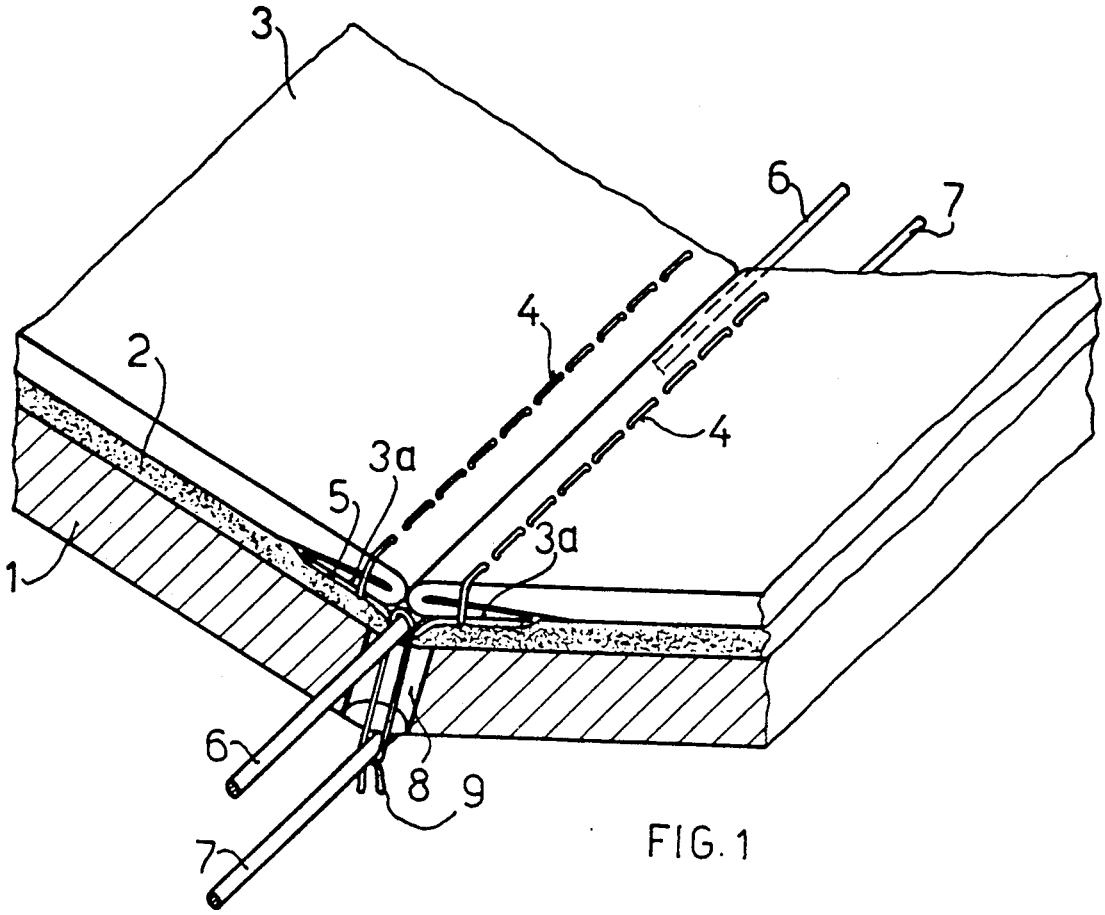
FIG. 1 is a fragmentary perspective view of an attachment for maintaining a covering layer in a position of overlap with a supporting structure.
Figure 2:
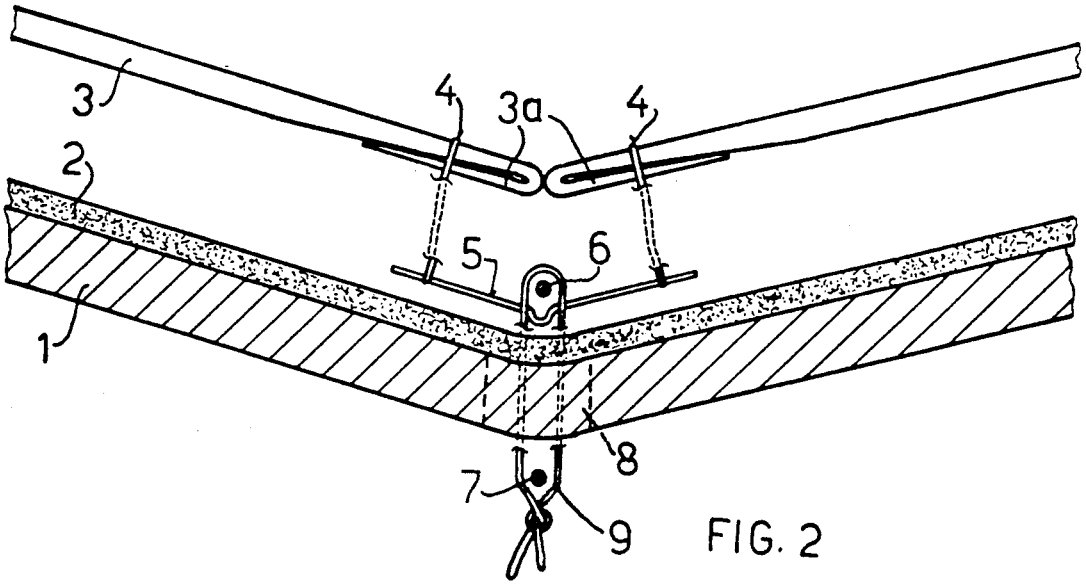
FIG. 2 is a partly exploded view of the attachment of FIG. 1.

Referring first to FIGS. 1 and 2, there is shown an attachment which is used to secure a two-piece covering layer to a supporting structure 1. The latter can constitute or form part of a frame of a seat or of a frame of an armchair or any other structure which is to be concealed by a preferably decorative or decorative and utilitarian covering layer. The layer can consist of leather, a textile sheet material or a plastic sheet material. As shown, the covering layer includes two flexible sections 3 which have abutting or closely adjacent folded-over marginal portions 3*a*. The inner side or surface 3A of the covering layer including the sections 3 faces toward the supporting structure 1 and that portion of the inner surface 3A which is adjacent the marginal portions 3*a* overlies a flexible panel-like insert 5 which forms part of the improved attachment and is mechanically fastened to the marginal portions 3*a* by rows of decorative stitches 4 which also constitute component parts of the attachment. Portions of the rows of stitches 4 are visible at the exposed outer side or surface 3B of the composite covering layer including the sections 3.

A layer 2 of padding is applied over the supporting structure 1 prior to securing the covering layer and the insert 5 by a securing means including two substantially parallel elongated rod-like fastening or securing elements 6, 7 and one or more lengths of a thread-like connector 9 having loops extending through openings in the form of holes 8 provided in that portion 1*a* of the supporting structure 1 which is adjacent the insert 5. The padding layer 2 can be made of foam rubber or any other suitable cushioning material which can but need not be bonded or otherwise secured to the adjacent side of the supporting structure 1.

The folded-over marginal portions or flaps 3*a* of the sections 3 are optional but desirable and advantageous because they enhance the strength of the covering layer in the region of the insert 5.

The manner of attaching the sections 3 of the covering layer is as follows: The elongated rod-like fastening or securing element 6 can be placed between the insert 5 and the folded-over marginal portions 3*a* before the insert is mechanically fastened to the sections 3 of the covering layer by stitches 4. The element 6 is then caused to overlie the padding layer 2 adjacent the portion 1*a* of the supporting structure 1, and the rod-like fastening or securing element 7 is placed against the rear or inner side of the portion 1*a* so that the latter is disposed between the elements 6 and 7. The connector 9 is thereupon applied by means of a suitable needle or other implement (not shown) and its end portions are caused to form one or more knots 9*a* adjacent the element 7. Portions of the connector 9 can extend through the aforementioned openings or holes 8 of the supporting structure 1.

The insert 5 can be made of a strong textile material which reinforces the adjacent portions of the sections 3. As mentioned above, the folded-over flap-like marginal portions 3*a* are optional and are normally provided only to enhance the strength of the respective portion of the composite covering layer by reducing the likelihood that the stitches 4 would tear the adjacent portions of the covering layer. The securing or fastening elements 6 and 7 can constitute small-diameter rods of a suitable metallic material. The connector 9 can be made of a metallic, textile or synthetic plastic material and can include one, two or more twisted and/or otherwise connected filaments.

An important advantage of the improved attachment is that all or nearly all tensile stresses are taken up by the stitches 4, by the rod-like elements 6, 7, by the insert 5 and by the connector 9. This prolongs the useful life of the composite covering layer. Moreover, and since the attachment need not employ any adhesive, the likelihood of discoloration of the marginal portions of the sections 3 of the covering layer is practically nil. Still further, the stitches 4 can actually enhance the appearance of the object (e.g., a chair, a seat, an armchair, an arm rest, a dashboard or the like) in which the improved attachment is put to use. The attachment is highly versatile in that it can readily conform to the curvature (if any) of the supporting structure 1 or of certain portions of the supporting structure. All that is necessary is to bend the rod-like element 6 so that it follows the outline of that side of the portion 1*a* of the supporting structure which confronts the insert 5. The openings or holes 8 can be distributed along the insert 5 in such a way that they enable the connector 9 to form any desired number of loops which is necessary to reliably connect the insert 5 (and hence the sections 3 of the covering layer) to the adjacent portions of the supporting structure 1. In addition, the loops of the connector 9 can be tightened to a desired extent to thus further enable the maker to select the magnitude of force with which the insert 5 is tied to the elements 6, 7 and hence to the portion 1*a* of the supporting structure 1. The strength of the connection between the marginal portions of the sections 3 of the covering layer can be selected in advance by appropriate selection of the strength of the material of the stitches 4 and/or by appropriate selection of the number of rows of stitches which connect the sections 3 to the insert 5. The feature that the strength of the connection between the marginal portions of the sections 3 and the insert 5, and/or the strength of connection between the insert 5 and the portion 1*a* of the supporting structure 1, can be varied within a wide range is especially desirable and advantageous if the supporting structure has a complex configuration with pronounced concave and/or convex portions which should be concealed by the covering layer and the latter should closely or reasonably closely follow the outline of the supporting structure.

Figure 3:
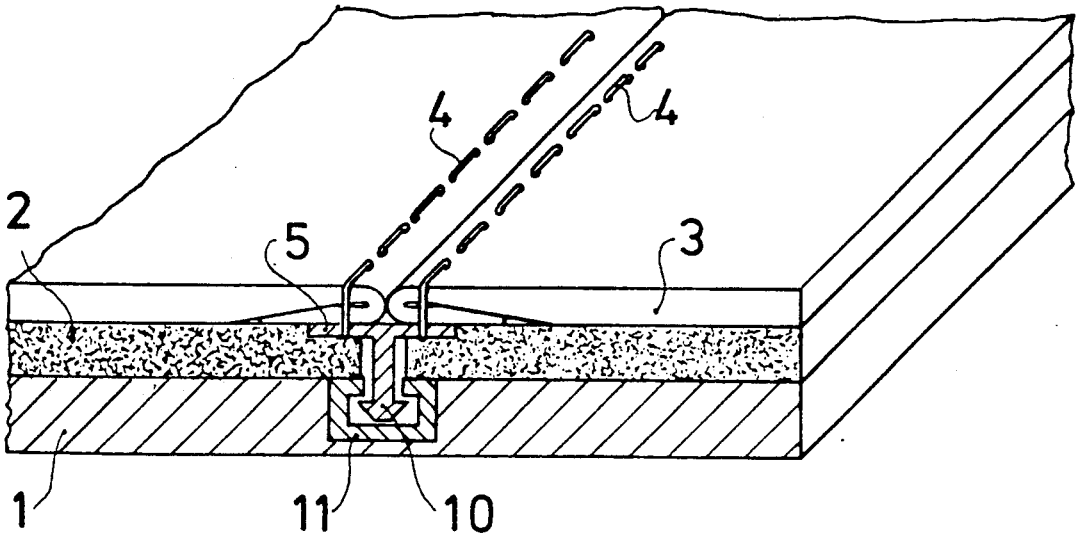
FIG. 3 is a fragmentary perspective view of a second attachment.

FIG. 3 shows a portion of a second attachment wherein the means for securing the insert 5 to the adjacent portion 1*a* of the supporting structure 1 includes a male first detent element 10 constituting an integral part of the insert 5 and a female second detent element 11 which is recessed into the portion 1*a* and constitutes a socket arranged to receive the enlarged portion or head of the male detent element 10 by snap action. As shown, the socket 11 has an elongated chamber and a constriction defining an inlet to the chamber, and the enlarged portion of the detent element 10 is dimensioned in such a way that it must be forced through the inlet in order to enter the chamber of the socket 11. It is clear that the one-piece female detent element 11 can be replaced by a series of discrete female detent elements and that the insert 5 can be made integral with a file of discrete male detent elements each of which is receivable in a discrete female detent element. The insert 5 can be made of a suitable plastic material and its enlarged portion can constitute a single elongated head or such enlarged portion can include discrete barbs or otherwise configurated projections which are deformable so that they can pass through the inlet on their way into the chamber of the female detent element 11. Such plastic insert can be mass produced in a suitable extruding or other plastic processing machine. The illustrated female detent element 11 is a substantially C-shaped rail which is or can be made of the same material as the male detent element 10 and can be a tight fit in or can be bonded to the surface bounding the recess in the portion 1*a* of the supporting structure 1. The strength of the attachment including the insert 5, the stitches 4 and the detent elements 10, 11 of FIG. 3 can be selected practically at will, for example, by appropriate selection of the rigidity of the material of the detent elements, by appropriate selection of the width of the inlet to the chamber of the female detent element 11 and/or by appropriate selection of the dimensions of the enlarged portion of the male detent element 10.

Figure 4:
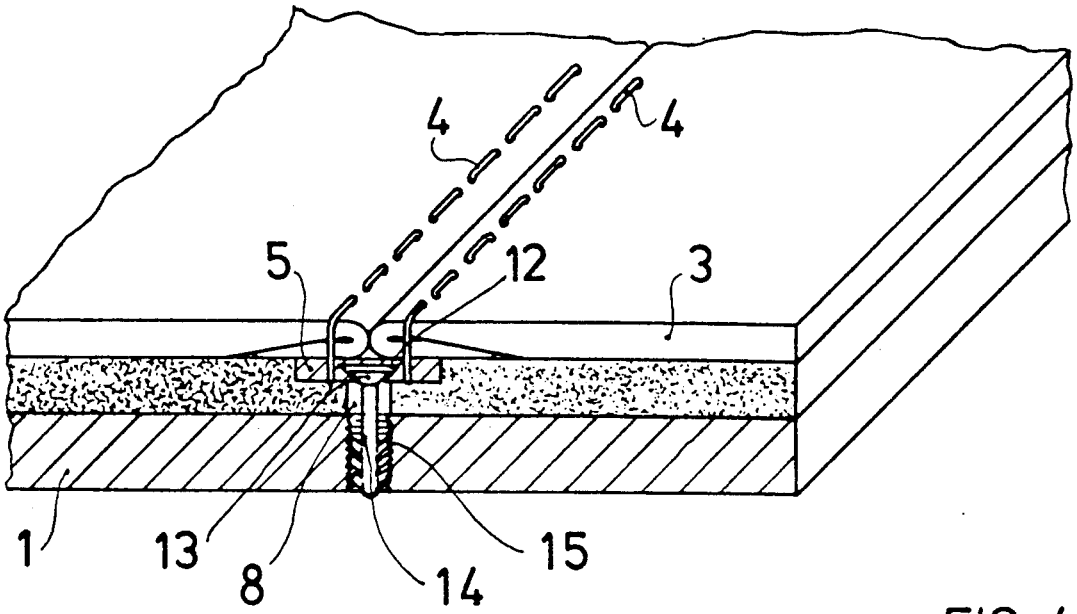
FIG. 4 is a fragmentary perspective view of a third attachment.

FIG. 4 shows a third attachment wherein the insert 5 has a substantially dovetailed recess 12 whose open side faces the marginal portions of the sections 3. The central portion of this insert can be said to constitute a female detent element which cooperates with one or more male detent elements each having an enlarged portion or head 13 in the recess 12 and a shank 14 which is anchored in a tapped hole or bore 15 in the portion 1*a* of the supporting structure 1. The shank 14 can have at least one projection in the form of a barb or a helical thread so that it can enter the hole 15 and thereupon cooperates with the surface bounding such hole to strongly oppose extraction of the male detent element from the supporting structure 1. The insert 5 can constitute a strip or band of plastic material which can be readily penetrated by a tool serving to apply the stitches 4 but which is sufficiently strong to reliably retain the head or heads of one or more male detent elements whose shank or shanks are anchored in the supporting structure 1. Each male detent element can be made of a material which is at least slightly elastic so as to allow for some deformation of the projection or projections during penetration into the respective hole 15 of the supporting structure 1. For example, each male detent element can be made of a material which is identical with or exhibits characteristcs similar to those of the insert 5. The tapped hole or holes 15 can be provided in addition to or in lieu of the openings or holes 8. The term "tapped" is intended to be interpreted in the broadest possible sense so as to embrace a mere roughening of the surface or surfaces bounding the hole or holes 15, as long as such roughening suffices to ensure reliable retention of the shank or shanks 14 against accidental extraction and separation from the supporting structure 1. For example, each shank 14 can have at least one pair of barb-like wings which project laterally beyond its main portion and can be deformed during penetration into the respective hole 15 to engage the roughened or otherwise configurated surface bounding the hole for the purpose of reliably anchoring the respective male detent element in the supporting structure 1.

The illustrated composite covering layer can be replaced with a one-piece covering layer without departing from the spirit of the invention. It is even possible to replace the rows of stitches 4 with rows of staples or analogous mechanical fasteners but the utilization of mechanical fasteners in the form of stitches is preferred at this time because they contribute to the appearance and softness of the attachment. The layer 2 of padding is optional. If desired, such padding can be more or less permanently attached to the inner side or surface 3A of the covering layer before the latter is secured to the supporting structure 1. The padding layer 2 can be disposed between the covering layer and the insert 5 or it can overlie that side of the insert which faces toward the supporting structure 1.

An advantage which is shared by all illustrated embodiments of the improved attachment is that the marginal portions of the sections 3 need not be adhesively secured to the supporting structure. Another advantage of all of the illustrated embodiments of the improved attachment is that the magnitude of the force with which the insert 5 is secured to the covering layer and/or to the supporting structure can be varied within a desired range by selecting the number and/or strength of the stitches 4 and/or by selecting the nature, dimensions and/or other parameters of the means for securing the insert to the adjacent portion of the supporting structure. With reference to FIGS. 1 and 2, the strength of the means for connecting the insert 5 to the supporting structure 1 can be chosen by appropriate selection of the connector 9 and/or of the tightness of loops which are formed to connect the rod-like fastening or securing elements 6, 7 to each other. In the embodiment of FIG. 3, the strength of the connection between the insert 5 and the supporting structure 1 can be selected by appropriate selection of the nature and/or dimensions and/or number of detent elements 10 and 11. In the embodiment of FIG. 4, the strength of the connection between the insert 5 and the supporting structure 1 can be selected by appropriate selection of the number and configuration of projections on the shanks 14, by the configuration of the surfaces bounding the holes 15 and/or by the extent to which the shanks 14 are driven into the respective holes 15.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. The combination of a supporting structure and an exposed covering layer, having a first side facing toward and a second side facing away from the supporting structure, with an attachment for maintaining the layer in a position of overlap with the supporting structure, said attachment comprising a substantially plane insert adjacent a selected portion of the first side of the covering layer; means for mechanically fastening the insert only to the covering layer; and means for securing the insert only to the supporting structure.

2. The combination of claim 1, wherein said fastening means includes stitches.

3. The combination of claim 1, wherein the covering layer is a decorative layer and said fastening means includes at least one row of stitches.

4. The combination of claim 1, wherein said insert includes an elongated band and said fastening means includes at least one row of stitches extending longitudally of said band.

5. The combination of claim 1, wherein said securing means comprises at least one first detent element on said insert and a complementary second detent element provided on the supporting structure and engaging said first detent element.

6. The combination of claim 5, wherein said first detent element is a male detent element and said second detent element is a female detent element.

7. The combination of claim 5, wherein one of said detent elements includes a socket and the other of said detent elements is receivable in said socket by snap action.

8. The combination of claim 7, wherein said socket has a chamber and a construction defining an inlet to said chamber, said other detent element having a head which is forcibly insertable into said chamber by way of said inlet.

9. The combination of claim 1, wherein the covering layer has two sections with abutting marginal portions overlying said insert, said fastening means including stitches connecting said marginal portions to said insert.

10. The combination of claim 9, wherein at least one of said marginal portions has a flap directly abutting said insert.

11. The combination of a supporting structure and a covering layer, having a first side facing toward and a second side facing away from the supporting structure, with an attachment for maintaining the layer in a position of overlap with the supporting structure, said attachment comprising a substantially plane insert adjacent a selected portion of the first side of the covering layer; means for mechanically fastening the insert to the covering layer; and means for securing the insert to the supporting structure, including a first fastening element disposed between said insert and the first side of the covering layer, a second fastening element, and a substantially thread-shaped connector securing said fastening elements to each other, the supporting structure having a portion disposed between said fastening elements.

12. The combination of claim 11, wherein at least one of said fastening elements is elongated.

13. The combination of claim 11, wherein at least one of said fastening elements includes a rod and said connector extends through said portion of the supporting structure and has at least one knot adjacent said second fastening element.

14. The combination of claim 11, wherein said first detent element is integral with said insert.

15. The combination of claim 14, wherein said first detent element has a dovetailed recess facing away from the covering layer and said second detent element includes a head in said recess and a shank anchored in the supporting structure.

16. The combination of claim 15, wherein said shank has at least one projection and the supporting structure has a hole which confines said projection.

17. The combination of claim 16, wherein the hole of the supporting structure is tapped.

18. The combination of a supporting structure and a covering layer, having a first side facing toward and a second side facing away from the supporting structure, with a padding which is interposed between the supporting structure and the covering layer, and with an attachment for maintaining the layer in a position of overlap with the supporting structure, said attachment comprising a substantially plane insert adjacent a selected portion of the first side of the covering layer; means for mechanically fastening the insert to the covering layer; and means for securing the insert to the supporting structure.

* * * * *